United States Patent [19]

Kataoka

[11] Patent Number: 4,523,421

[45] Date of Patent: Jun. 18, 1985

[54] METHOD AND APPARATUS FOR WRAPPING METAL COIL

[76] Inventor: Hiroshi Kataoka, 1-5-8 Asahi, Iyo-Mishima-shi, Ehime-ken, Japan

[21] Appl. No.: 381,308

[22] Filed: May 24, 1982

[51] Int. Cl.[3] ..... B65B 13/02

[52] U.S. Cl. ..... 53/399; 53/465; 53/588

[58] Field of Search ..... 53/210, 399, 465, 588; 100/8, 27; 156/446, 517

[56] References Cited

U.S. PATENT DOCUMENTS

| | | | |
|---|---|---|---|
| 3,910,005 | 10/1975 | Thimon et al. | 53/588 X |
| 4,067,174 | 1/1978 | Goldstein | 53/210 X |
| 4,302,920 | 12/1981 | Lancaster et al. | 53/399 |

*Primary Examiner*—John Sipos
*Assistant Examiner*—Steven P. Weihrouch
*Attorney, Agent, or Firm*—Oblon, Fisher, Spivak, McClelland & Maier

[57] ABSTRACT

Wrapping of a coiled strip of thin sheet of steel or other metal produced in a rolling mill is accomplished by placing under the coiled strip a wrapping paper of a suitable width cut to a length sufficient to encircle the outer periphery of the coiled strip, winding the leading half of the wrapping paper on a rolling core, fixing the tail end of the wrapping paper in position, rotating the aforementioned rolling core in the direction of unwinding the wound wrapping paper and at the same time, revolving the rolling core around the outer periphery of the coiled strip thereby winding the unwound wrapping paper on the coiled strip, thereafter superposing the leading end and the tail end of the wrapping paper one over the other and joining the overlapping ends fast to each other.

1 Claim, 7 Drawing Figures

1'
23
25
10
P
26
24
27a
11
9
27
1
12
13
14
2
15
3b
C
3
3a
101
A
6
17
21
100
8
19
18
16
20
7
4
5a
22
5

METHOD AND APPARATUS FOR WRAPPING METAL COIL

BACKGROUND OF THE INVENTION

This invention relates to method and apparatus for wrapping a coil of metal strip (hereinafter referred to as "metal coil"). Generally, a metal coil obtained by rolling a metal into a thin strip of sheet and winding this strip into a coil is shipped out as enclosed in a wrapping paper.

Wrapping a coil of thin steel sheet produced in a steel mill, for example, is effected by covering the inner peripheral surface of the coil with a wrapping paper, winding a wrapping paper of large width on the outer peripheral surface of the coil, and folding down toward the center of the coil the excess widths of the wrapping paper extruding from the opposite edges of the roll to cover the edge faces of the coil. The manual work of winding the wrapping paper of the excess widths accurately and tightly on the metal coil has proved to be difficult.

Mechanization of continuous winding work is easy. In contrast, mechanization of the work of winding a wrapping paper just once around the outer periphery of a coil is unexpectedly difficult and remains yet to be developed. The work, therefore, is still being performed by a troublesome manual procedure.

SUMMARY OF THE INVENTION

One object of this invention is to provide a very simple and efficient method for winding a wrapping paper on the outer periphery of a metal coil and an apparatus for mechanizing this method.

Another object of this invention is to provide a method for winding a wrapping paper on a metal coil by first winding the wrapping paper on a winding core and then rotating the winding core in the direction of unwinding the wound wrapping paper and, at the same time, revolving the winding core around the outer periphery of the metal coil and an apparatus for effecting this method.

Yet another object of this invention is to provide an apparatus for causing wrapping paper paid off its roll and therefore tending to curl back to be straightened out as drawn flat and forwarding the flattened wrapping paper in the direction of the metal coil to be wrapped.

A further object of this invention is to provide an apparatus for correcting the curling tendency of wrapping paper paid off its roll and forwarding the flattened wrapping paper in the direction of the metal coil to be wrapped.

To accomplish the objects described above according to the present invention, there is provided a method and apparatus for winding wrapping paper on the outer periphery of a metal coil, which comprises the steps of selecting from among a plurality of rolls of wrapping paper of gradually varied widths a particular roll of wrapping paper having a required width, drawing the wrapping paper out of the roll and cutting the drawn paper to a length enough to encircle the outer peripheral length of the metal coil being wrapped, transferring the cut length of wrapping paper as drawn straight to a position directly below coil being wrapped, transferring the cut length of wrapping paper as drawn straight to a position directly below the metal coil held in a suspended state, winding the wrapping paper on a winding roll held fast horizontally at a position slightly forward from the vertical line passing through the center of the metal coil, discontinuing the winding of the wrapping paper after the tail end of the cut wrapping paper has been brought to a position slightly rearward from the aforementioned vertical line and secured at that position, rendering the aforementioned winding roll rotatable and moving the roll upwardly, then transversely, and finally downwardly, causing the wrapping paper to be unwound from the winding roll owing to the attraction exerted by the tail end of the wrapping paper held fast in position as described above and to be wrapped on the lower half and the upper whole of the outer periphery of the metal coil, and joining the leading end of wrapping paper released from the winding roll and the tail end of the same wrapping paper on the outer periphery of the metal coil.

In addition to being capable of accomplishing the various objects described above, the present invention produces the following operation and effect. Unlike the conventional manual work which relies on a worker to take hold of the leading end of a cut length of wrapping paper and wind the paper all around the outer periphery of the metal coil, the present invention first causes a winding roll to take up thereon a length of wrapping paper and then allows the winding roll to be rotated in the direction of paying off the wound wrapping paper and, at the same time, revolved around the outer perrphery of the coil being wrapped. Since the wrapping paper is kept uniform at all times relative to the direction of its own length and brought in parallel to the surface of the coil, there is absolutely no possibility of the wrapping paper producing warps and wrinkles.

While the wrapping paper is being wound on the metal coil, the winding roll is rotated to pay off the wound wrapping paper owing to the restraint of the tail end of the wrapping paper. By regulating the braking mechanism for this unwinding rotation, the tension with which the wrapping paper is wound on the metal coil can be properly adjusted. Thus, the wrapping paper may be wound tightly or loosely on the outer periphery of the metal coil at will. For the same purpose, the winding roll may be revolved as held intimately on the outer periphery of the metal coil to effect tight winding of the wrapping paper or as held slightly apart from the outer periphery of the metal coil to effect loose winding.

The winding of wrapping paper by means of the winding roll is such that required wrapping of the metal coil can be safely accomplished even when the metal coil is more or less off the designated position or when the metal coil moves while the winding is in process. Consequently, it has now become feasible for the metal coil to be wrapped on the outer periphery thereof as suspended from a crane and, on completion of the wrapping, transferred to a position fixed for the wrapping of the opposite edge surfaces thereof.

Further from the standpoint of safety of work, the fact that no worker need use any edged tool designed for cutting the wrapping paper during the work of wrapping constitutes a conspicuous effect of this invention.

DETAILED DESCRIPTION OF PREFERRED EMBODIMENTS

Figures 1, 2:
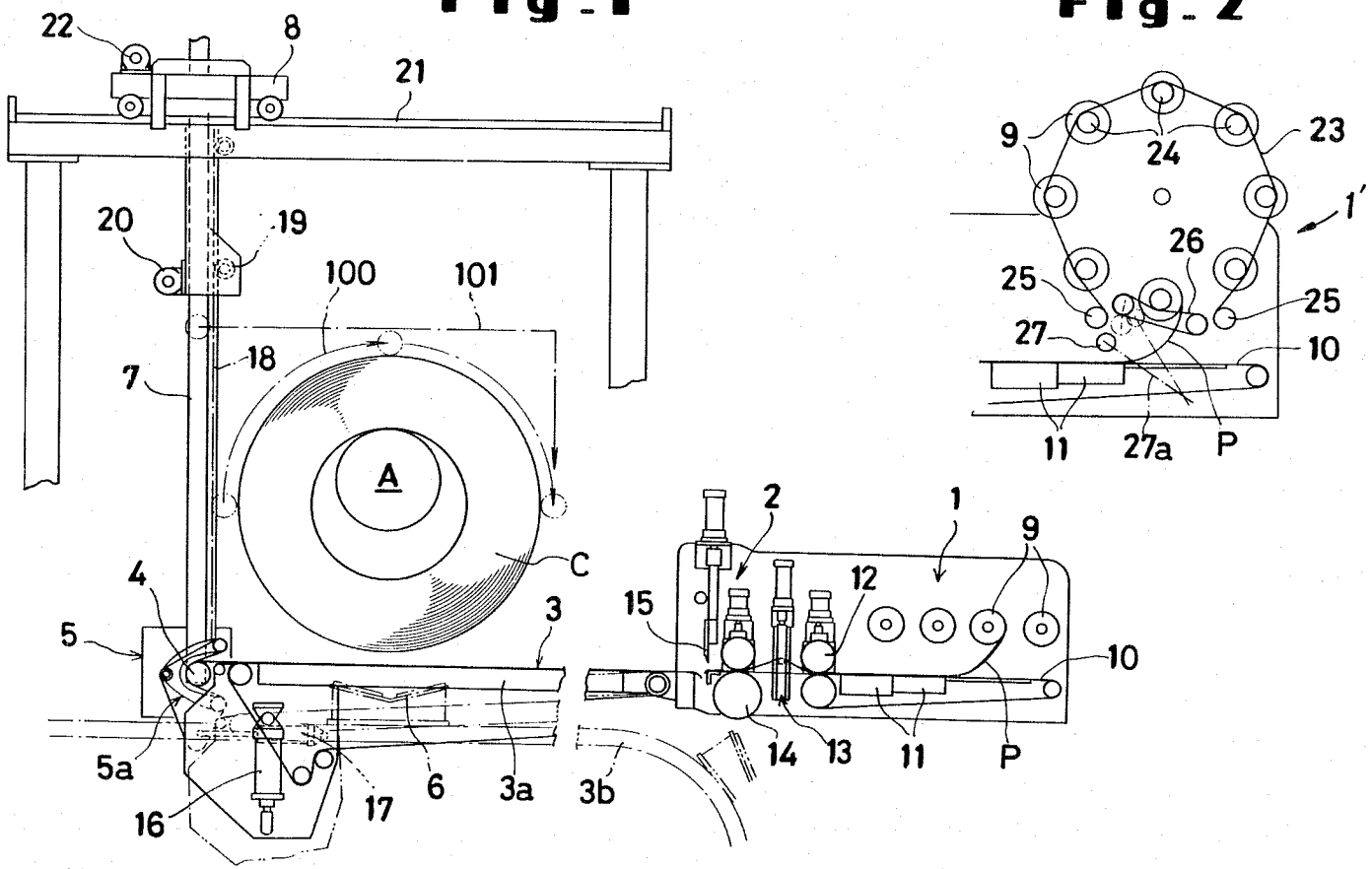
FIG. 1 is a front view of one embodiment of the wrapping apparatus according to the present invention.
FIG. 2 is a front view of another embodiment of the storage for wrapping paper rolls in the apparatus of FIG. 1.

FIG. 1 represents one embodiment of the present invention. The article to be wrapped in this embodiment is a coil C of thin steel sheet. In the present case, the coil C is supported on a suspension arm A and suspended in position slightly above a coil receiving seat 6 of a slat conveyor 3*b*. After wrapping paper has been set in position below the coil, the coil C is lowered onto the receiving seat 6, wrapped on the outer periphery with the wrapping paper, and immediately transferred to the next step of operation.

The principal parts of the wrapping apparatus of this embodiment are storage 1 for wrapping paper rolls, mechanism 2 for drawing out the wrapping paper from its roll, correcting the curling tendency of the drawn wrapping paper, and cutting the wrapping paper to a required length, conveyor 3 for transferring the cut length of wrapping paper to below the coil C, winding roll 4 for winding thereon the cut length of wrapping paper, winding mechanism 5, means for restraining the tail end of the cut length of wrapping paper, e.g. a suction belt 3*a* of the aforementioned conveyor 3 in the present case, suspension arms 7 for supporting in position the aforementioned winding roll 4, supporting trolley 8 to which the arms 7 are attached fast, etc.

The method of wrapping according to the present invention will be described below with reference to the construction of the present embodiment. It should be noted here that for the method of this invention, use of the apparatus of this invention is not an essential requirement.

In the storage 1 for wrapping paper rolls, a plurality of wrapping paper rolls 9 of varying widths are disposed in such a manner that any one of the rolls may be picked out at will to pay off the wrapping paper. From the plurality of rolls 9, one particular roll of wrapping paper having the required width is selected and rotated to pay off the wrapping paper. The wrapping paper thus drawn out of the roll is cut to a length conforming to the length of the outer periphery of the coil C, the article subjected to wrapping in this case. This work forms the first step of the wrapping operation. Below the storage 1 for wrapping paper rolls, several well-known endless belts containing suction holes are arrayed on a wrapping paper drawing conveyor 10. The leading end of the wrapping paper P placed on the belts is advanced as sucked to the belts by the suction box 11 and a blower not shown in the drawing until it is caught fast between forwarding nip rollers 12.

The leading end of the wrapping paper P is passed through a mechanism 13 for correcting the curling tendency of wrapping paper and discharge nip rollers 14 and delivered to the subsequent feed conveyor 3. On receipt of a signal from a paper length sensing mechanism which is omitted from the drawing, a cutter 15 cuts the wrapping paper P to a length conforming to the length of outer periphery of the coil C. The cut length of wrapping paper P is mounted as stretched to full length on the conveyor 3 and advanced through the slat conveyor 3*b* to a position below the coil C. The mechanisms for feeding the wrapping paper and for correcting the curling tendency of wrapping paper paid off the coil will be described in detail afterward. In the present embodiment, the middlemost of the intervals between the perforated parallel belts 3*a* of the conveyor 3 is given a greater lateral dimension to permit disposition of the slat conveyor 3*b* which serves as a path for conveyance of the coil C. Optionally the whole conveyor 3 may be kept at a lowered level by means of a hydraulic cylinder 16 during the conveyance of the coil C.

During the entry of the cut length of wrapping paper P, since the conveyor 3 is kept at its normal elevated level, the cut length of wrapping paper advances directly below the coil C.

The winding roll 4 is laid immediately in front of the terminal end of the endless belts 3*a* of the conveyor 3, namely at a position slightly forward from the position directly below the center of the coil C. This winding roll is rotationally driven by the winding mechanism 5 through the medium of a clutch. The winding mechanism 5 is provided with a well-known contact type guide belt mechanism 5*a* in order to set the leading end of the cut length of wrapping paper P to the periphery of the winding roll 4. In order for the guide belt mechanism to be retracted downwardly while not in use, it is adapted to be rotatable by the hydraulic cylinder 17.

In response to the issuance of a signal indicating the arrival of the cut length of wrapping paper P on the conveyor 3 or in accordance with the shift of the conveyor 3 from the lower retracted position to the position indicated by a continuous line in the drawing or the rotary elevation of the guide belt mechanism 5*a*, the winding mechanism 5 rotationally drives the winding roll 4. When the leading end of the wrapping paper P mounted on the conveyor 3 hits either the belt of the guide belt mechanism 5*a* or the winding roll 4, it is immediately drawn in between the belt and the winding roll 4 and is gradually taken up.

The winding mechanism 5 is stopped as soon as it is detected that the tail end of the cut length of wrapping paper P has reached a position slightly in front of the position directly below the center of the coil C. Before the stop of the winding mechanism 5, the guide belt mechanism 5*a* which has fulfilled its object of winding the wrapping paper on the winding roll is lowered by the hydraulic cylinder 17. The rear part of the cut length of wrapping paper P which remains on the conveyor 3 is secured in position on the conveyor owing to the suction which is effected by the parallel belts 3*a*.

When the winding mechanism 5 ceases to wind the wrapping paper on the winding roll, it automatically releases the clutch which interlocks the mechanism with the winding roll 4. (In the case of a magnetic powder clutch, it is caused to generate a braking motion by weakening the control current flowing therethrough.) Consequently, the winding roll 4 is now free to be rotated. Then, a pinion 19 meshed with a rack 18 is rotationally driven by a motor 20 so as to contract the opposite suspension arms 7 which support the winding roll 4 at the lower ends thereof and enable the winding roll 4 to be moved vertically. As the winding roll 4 is elevated in consequence of the rotation of the pinion 19, the cut length of wrapping paper P which has its tail end restrained is drawn toward its tail end and gradually paid off the roll 4. The portion of the wrapping paper P thus paid off the roll is gradually draped on the lower side of the coil C in the left half of the diagram of FIG. 1. When the winding roll 4 reaches the position corresponding to the center of the coil C, the supporting trolley 8 which supports the suspension arms 7 in position and which is carried on horizontal rails 21 is advanced to the right with respect to the diagram of FIG. 1. After the winding roll 4 has come into contact with the surface of the coil C, it is revolved around the surface of the coil C as rotated around itself, with the result that the winding roll 4 describes a locus 100 along which the wrapped paper paid off the winding roll 4 is draped on the surface of the coil C. This draping of the wrapping paper on the metal coil is effected smoothly by controlling, with the aid of a computer, the motor 20 for vertical motion of the winding roll and a motor 22 for the lateral motion on the trolley 8 in accordance with the diameter of the coil C being wrapped. It may otherwise be effected more simply by elevating the winding roll 4 without any lateral shift of position to a level slightly higher than the apex of the coil C and subsequently advancing the winding roll 4 straight in the horizontal direction, and lowering it straight in the vertical line, so as to describe a locus 101. Even in the case of the locus 100, the winding roll 4 may be revolved around the coil C with a distance kept from the surface of the coil C instead of being kept in contact with the surface. The strength with which the wrapping paper P is wound on the coil C can be suitably adjusted by the braking (frictional) force exerted on the rotation of the winding roll. For the purpose of keeping the leading end of the wrapping paper P fast to the winding roll, the known technique of perforating small holes in the winding roll and causing the leading end of wrapping paper to be drawn fast to the winding roll by virtue of suction may be advantageously adopted.

When the winding roll 4 has reached or advanced slightly past the end point of the aforementioned locus 100 or 101, the cut length of wrapping paper is completely separated from the winding roll 4. Thus, the winding roll 4 is returned to its original position. At this point, the leading end of the cut length of wrapping paper separated from and hung down the winding roll 4 and the tail end of the wrapping paper still drawn fast to the conveyor 3 are joined to each other on the outer periphery of the coil C.

In the present embodiment, the draping of wrapping paper on the lower half portion and the whole upper portion of the outer periphery of the coil C is accomplished completely automatically. The work of joining the leading and tail ends of the cut length of wrapping paper thereby effecting the draping of the wrapping paper on the remaining lower half portion is carried out manually. The portion of the operation which is performed manually can be mechanized by incorporating a mechanism which is capable of applying a double-faced adhesive tape along the tail end of the wrapping paper on the conveyor 3, scooping the tail end, applying it to the surface of the coil with the aid of the adhesive tape, superposing the leading end of the wrapping paper suspended from above over the leading end, and joining the two ends through the medium of the adhesive tape.

The conveyor 3 for feeding the cut length of wrapping paper need not be what is normally called a conveyor but may be a flat surface adapted to slide the wrapping paper. In fact, any device can be used on the sole condition that it is capable of advancing the cut length of wrapping paper as held in a flattened state. In the embodiment described above, the restraint of the tail end of the cut length of wrapping paper is accomplished by the suction of the wrapping paper by the conveyor or the tight adhesion of the coil itself to the receiving seat for the slat conveyor. Various other means can be used, such as a suction means and pressure means which operate separately of the conveyor.

The supporting trolley 8 need not be what is generally passed as a trolley but may be a member adapted to slide on the rails. Further, the manner in which the rails are supported in position may be selected to suit the conditions of the work site. Whether the entire apparatus is adapted for complete serial control or part of the apparatus is subject to control by commands issued by an operator stationed to oversee the operation is a matter to be depending on shop conditions.

Optionally, the storage 1 for wrapping paper rolls may be designed in a rotary system as indicated by 1' in FIG. 2, which shows a rotary storage having a plurality of wrapping paper rolls 9 of varying widths disposed as regularly spaced circumferentially on a single circle. Of the plurality of rolls 9 of wrapping paper, the particular one having a required width is brought to the lowest point of the circle and the wrapping paper is drawn out of this particular roll. Each roll 9 of wrapping paper is supported in position with a bearing which is provided with a well known frictionally braking pulley 24. A stationary belt 23 for braking is passed around the pulleys 24. Owing to this stationary belt 23, all the pulleys except for the pulley at the lowest point are frictionally restrained. The opposite stationary pulleys 25 fasten the opposite ends of the braking belt 23 and enable the belt 23 to be tightened or slackened as required.

After the particular roll 9 of wrapping paper having a required width has been fixed at the lowest point of the circle of the rotary storage 1', the driven pulley side end of a driving endless belt 26 lying below the roll 9 is elevated and brought into contact with the pulley 24 as shown by a continuous line in the drawing by means of the driving mechanism which is not shown in the drawing. When the driving belt 26 is subsequently set rotating, the roll 9 of wrapping paper at the lowest point is rotated in the direction of unwinding the wrapping paper. The leading end of the wrapping paper P which hangs down from the roll 9 comes to rest on the surface of the floor. On the floor surface, are several parallel endless belts running together. Thus, the leading end of the wrapping paper P held on the belts is advanced to the left relative to the diagram of FIG. 1. Since a suction box 11 is located below the belts 10, the wrapping paper P is held in intimate contact with the belts 10 and, in that state, is advanced as described above.

After the portion of wrapping paper P paid off the roll 9 has been cut to a required length, the following portion of wrapping paper is taken up again on the roll 9. This rewinding of the remaining portion of wrapping paper is accomplished by rotating in the reverse direction the endless belt 26 which has been used formerly in causing the wrapping paper to be unwound from the roll. In this case, the remaining portion of wrapping paper is rewound with ample tightness by causing retaining rollers 27 at the leading ends of oscillation arms 27*a* to be pressed against the peripheral surface of the roll 9 of wrapping paper and actuating the touch rollers of the winding machine. Normally, the retaining rollers 27 are held in a lowered level close to the upper surface of the conveyor 10, ready for use. Of course, the oscillation arms 27*a* are located at the outsides of the feeding mechanism and the endless belt 26 is oscillated at the position at which the roll 9 of wrapping paper collides with the edge pulley 24. Thus, no hindrance is offered to the entry or departure of the wrapping paper P. The plan view depicting this condition is omitted.

Now, the mechanism peculiar to this invention which causes the wrapping paper drawn out of the coil in the storage 1 or 1′ and tending to curl up to be placed as stretched to full strength on the drawing conveyor, corrects the curling tendency of the wrapping paper, and forwards it in the form of a flat wrapping paper will be described with reference to the embodiments of FIGS. 4–7.

In a conventional automatic feed device, in order that a wrapping paper drawn out of a small roll 9 of wrapping paper and highly tending to curl up may be stretched flat and cut to a desired length, the operator has been compelled to keep the leading end of the wrapping paper pressed against the suction conveyor. The work of evenly pressing against the conveyor the leading end of a wrapping paper 900 to 1500 mm in width and having a high curling tendency is difficult and complicated to manually perform. In this respect, therefore, the conventional automatic feed device has hardly deserved the designation "automatic device".

Figure 3:
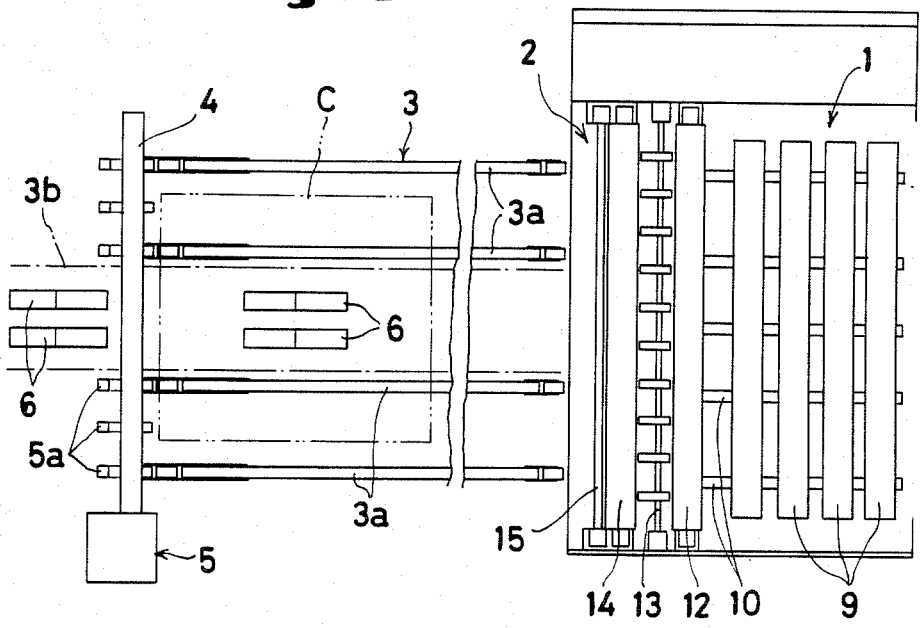
FIG. 3 is a plan view of the embodiment of FIG. 1.

The embodiments of FIGS. 4–7 adopts the rotary storage 1′ for wrapping paper rolls illustrated in FIG. 2. In FIGS. 4–7, the wrapping paper roll 9 is illustrated as positioned at the lowermost level. Below the roll is laid an extraction conveyor 10′, which precedes a mechanism 13 for correcting the curling tendency of wrapping paper and a cutter 15. Of the plurality of wrapping paper rolls of varying widths regularly spaced circumferentially on a circle, a roll of desired width is moved to the designated position, i.e. the lowermost level in the present embodiment. As means for moving the selected wrapping paper roll to the lowermost level, unwinding the wrapping paper from the roll, cutting the unwound wrapping paper to a prescribed length, and winding the cut length of wrapping paper on the outer periphery of the metal coil C, the present invention characteristically makes use of a movable inclined conveyor 28 and a suction conveyor 10′ adapted to revolve at a lower speed than the inclined conveyor 28. The latter conveyor is substantially the same as the extraction conveyor 10 illustrated in FIGS. 1–3.

The movable inclined conveyor 28 fulfills the function of frictionally driving aslant in the downward direction the leading end of the portion of the wrapping paper P unwound from the roll 9 and tending to curl up, specifically at the illustrated position. While the roll 9 of wrapping paper is in process of revolution around the metal coil C, the movable inclined conveyor is retracted.

Figure 4:
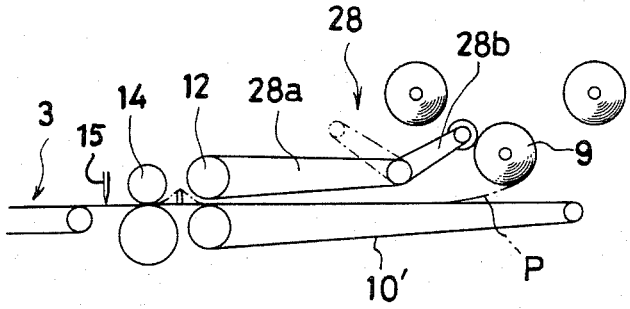
FIG. 4 is a front view of a wrapping paper feed device for drawing in a straightened state a wrapping paper from the storage for wrapping paper rolls of FIG. 2 and a device for correcting the curling tendency of the wrapping paper drawn out of the roll.
Figure 5:
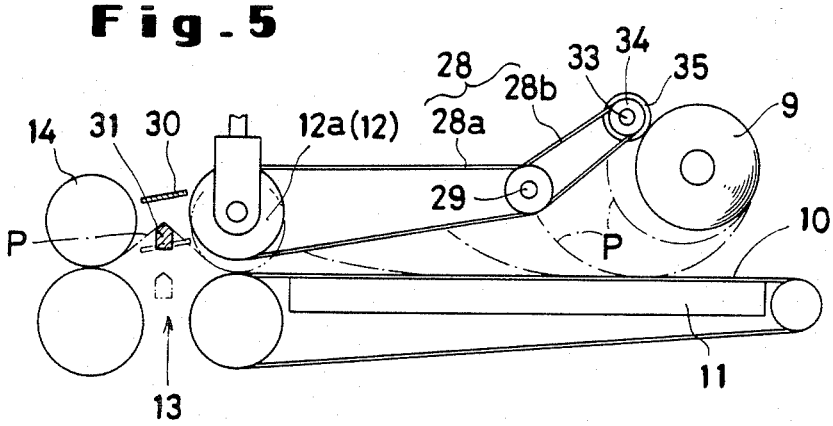
FIG. 5 is an enlarged explanatory view showing the embodiment of FIG. 4.
Figure 6:
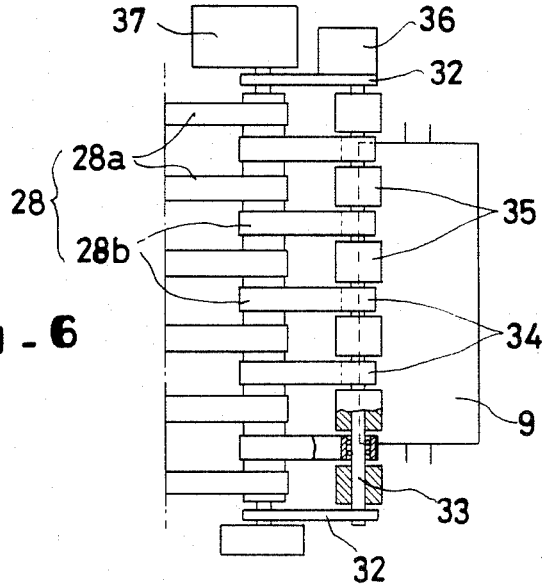
FIG. 6 is a plan view of the wrapping paper feed device of FIG. 4.

The movable inclined conveyor 28 in the embodiment of FIGS. 4–6 consists of two parts, i.e. a belt conveyor 28*a* having a relatively small angle of inclination and a sharply inclined belt conveyor 28*b* which is connected to the rear end of the aforementioned belt conveyor 28*a*. These two conveyors are connected to each other by a common combination rotary drive shaft and oscillation shaft 29. The driven side pulley 12*a* of the conveyor 28*a* concurrently serves as an upper movable roller for the rear side nip roller 12 of the curl correcting mechanism 13. The driven side pulley 34 of the sharply inclined belt conveyor 28*b* is idly joined to the movable shaft 33 and allowed to rotate freely. It can be moved either to approach the wrapping paper roll 9 or to assume its waiting position (indicated by a chain line in FIG. 4). This shift of the position of the pulley 34 is effected by a swing of the supporting arm 32 illustrated in FIG. 6. The drive mechanism for this pulley 34 is omitted from the drawing.

As is clear from FIG. 6, the wrapping paper roll 9 side end of the conveyor 28 in the present embodiment has contact rolls 35 interposed one each between the parallel belt pulleys 34. These rolls 35 are invariably driven by a shaft 35 and a drive mechanism 36 and the pulleys 34 are freely rotated around the shaft 33.

When the contact rolls 35 are rotated at a suitable speed as held lightly in contact with the wrapping paper roll 9 as illustrated in FIGS. 4–5 and the belt conveyors 28*a*, 28*b* are rotated at a relatively high speed by the rotation of the shaft 29 and that of the drive mechanism 37, the leading end of wrapping paper which has advanced as unseparated from the surface of the wrapping paper roll 9 in the unwinding direction is scraped off the roll by the contact rolls 35 and consequently moved onto the surface of the conveyor 28*b*. As the rotation of the roll 9 in the unwinding direction proceeds, the leading end of the wrapping paper P is frictionally driven and moved from the conveyor 28*b* to the conveyor 28*a* and then advanced toward the nip rollers 12 formed by the leftmost pulleys of the upper and lower conveyors 28, 10′. Meanwhile, even when the leading end of the wrapping paper P tends to curl up into a loop owing to the curling tendency of the paper, it is continuously elongated because the inclined conveyor 28 runs at a higher speed than the unwinding speed of wrapping paper and the speed of the suction conveyor 10′. In the thus continuously elongated state, the leading end of wrapping paper is advanced toward the lower end of the inclined conveyor 28, namely toward the lower surface of the pulley 12*a*.

After passing the nip rollers 12 which concurrently serve as the pulleys for the upper and lower conveyors, the leading end of wrapping paper P continues to advance into the curl correcting mechanism 13, there to be given reverse strain and rendered substantially flat. The curl correcting mechanism 13 in this embodiment is provided with a guide plate 30, a curl removing member 31, and a mechanism for imparting a vertical motion thereto (omitted from the drawing). Originally located at the position indicated by the chain line, this mechanism advances the leading end of wrapping paper P along the guide plate 30 and inserts it between the nip rollers 14. Subsequently, it elevates the guide plate 30 and the curl removing member 31 to a level indicated by a continuous line in FIG. 5 and causes them to rub the wrapping paper P to impart reverse strain thereto.

In the present embodiment, the pulley 12*a* of the inclined conveyor 28 is vertically movable, so that, after the leading end of wrapping paper P has passed thereunder, it is lowered to the level indicated by the chain line in FIG. 5 and used as a nip roller. In that case, the drive mechanism 37 for the inclined conveyor 28 is idly rotated.

After the unwound portion of wrapping paper has been relieved of the curling tendency and cut to a required length, the remaining portion of the wrapping paper separated from the roll is taken up again on the roll by rotating the roll in its winding direction in exactly the same way as the conventional device. When a steel coil C of a different width is received, the wrapping paper roll side portion 28*b* of the inclined conveyor 28 is rotationally retracted around the center of the shaft 29 and it is brought back to its original position after a roll 9 of wrapping paper having the required width has been moved to the designated position.

Figure 7:
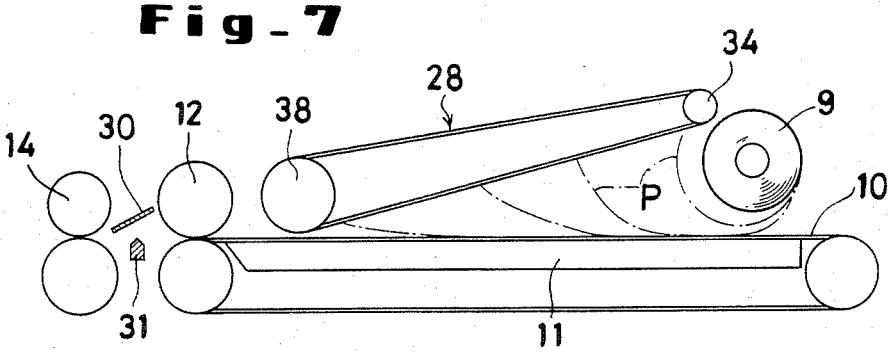
FIG. 7 is a front view of another embodiment of the wrapping paper feed device.

If a plurality of rolls 9 of wrapping paper are coaxially arrayed and a selected one of the rolls is moved to the designated position, the inclined conveyor 28 has no use for any folding mechanism as illustrated in FIG. 7. In the embodiment of FIG. 7, a pulley 38 of the inclined conveyor is stationary and the pulley 34 on the opposite side alone is slightly swingable to permit adjustment.

Since the lower surface of the aforementioned pulley 38 is close to the upper surface of the suction conveyor 10', the leading end of wrapping paper P which has passed through the gap between the opposed surfaces is safely sucked toward the suction conveyor 10' side and, in that state, fed into the curl correcting mechanism 13.

What is claimed is:

1. A method for winding a wrapping paper on the outer periphery of a metal coil, which comprises the steps of:

selecting from a plurality of rolls of wrapping paper having various widths in a storage one particular roll of wrapping paper of a required width, drawing the leading end of the wrapping paper out of the roll, correcting the curling tendency of the wrapping paper paid off the roll thereby stretching said wrapping paper to full length, cutting the drawn and corrected portion of wrapping paper to a length conforming to the length of the periphery of the metal coil being wrapped, forwarding by means of a conveyor the cut length of wrapping paper as stretched to full length to a position below said metal coil which is slightly lifted from the conveyor by a suspension arm, winding the cut and forwarded length of wrapping paper on a horizontally retained winding roll of a winding mechanism with a wrapping paper end winding belt disposed at a position slightly forward from the position directly below said metal coil, discontinuing the winding of wrapping paper at the time that the tail end of the cut length of wrapping paper has reached a predetermined position slightly rearward from the position directly below said metal coil, retaining said tail end of the cut length of wrapping paper at said predetermined position on said conveyor by applying suction from said conveyor to said tail end, rendering said winding roll rotatable and moving the winding roll, which has the cut length of wrapping paper wound thereon and retains its horizontal posture, upwardly, transversely and downwardly around said metal coil, thereby allowing the cut length of wrapping paper unwound from said winding roll to be draped on the lower half portion and the whole upper portion of the outer periphery of said metal coil, and manually joining the leading end of said cut length of wrapping paper separated from said winding roll and the tail end of wrapping paper to each other on the outer periphery of said metal coil.

* * * * *